US010842698B2

(12) United States Patent
Blackwell et al.

(10) Patent No.: US 10,842,698 B2
(45) Date of Patent: Nov. 24, 2020

(54) EXPANDABLE BASE PLATE FOR KNEE POSITIONER

(71) Applicant: Innovative Medical Products, Inc., Plainville, CT (US)

(72) Inventors: Tim Blackwell, Jupiter, FL (US); Tamas Kovacs, Bristol, CT (US)

(73) Assignee: INNOVATIVE MEDICAL PRODUCTS, INC., Plainville, CT (US)

( * ) Notice: Subject to any disclaimer, the term of this patent is extended or adjusted under 35 U.S.C. 154(b) by 532 days.

(21) Appl. No.: 14/726,601

(22) Filed: Jun. 1, 2015

(65) Prior Publication Data

US 2016/0346150 A1 Dec. 1, 2016

(51) Int. Cl.
*A61G 13/12* (2006.01)

(52) U.S. Cl.
CPC ..... *A61G 13/1245* (2013.01); *A61G 13/129* (2013.01)

(58) Field of Classification Search
CPC .. A61G 13/12; A61G 13/1205; A61G 13/121; A61G 13/122; A61G 13/1225; A61G 13/123; A61G 13/1235; A61G 13/124; A61G 13/1245; A61G 13/125; A61G 13/1255; A61G 13/126; A61G 13/128; A61G 13/1285; A61G 13/129; A61G 13/1295; A61G 13/101
See application file for complete search history.

(56) References Cited

U.S. PATENT DOCUMENTS

| | | | | |
|---|---|---|---|---|
| 2,743,975 | A * | 5/1956 | Stiefvater | A61G 13/12 5/647 |
| 3,046,072 | A * | 7/1962 | Douglass, Jr. | A61G 13/12 5/623 |
| 4,054,282 | A * | 10/1977 | Hamer | A61G 13/12 5/610 |
| 4,968,013 | A * | 11/1990 | Kuck | A61G 13/10 5/600 |
| 5,154,723 | A * | 10/1992 | Kubota | A61G 13/12 600/102 |
| 5,645,079 | A * | 7/1997 | Zahiri | A61F 5/3769 128/882 |
| 5,681,018 | A * | 10/1997 | Hoftman | A61G 13/101 248/125.8 |
| 6,568,010 | B1 * | 5/2003 | Ames | A61G 13/12 5/621 |
| 7,426,930 | B1 * | 9/2008 | Bailey | A61G 7/05 128/112.1 |

(Continued)

*Primary Examiner* — Eric J Kurilla
*Assistant Examiner* — Amanda L Bailey
(74) *Attorney, Agent, or Firm* — Wasserbauer Law LLC; Damian G. Wasserbauer, Esq.

(57) ABSTRACT

An expandable plate configured to expand and to hold, move and maintain a body part in a specific position as needed in orthopedic surgery. The expandable plate has a bed with a guide assembly formed in a top surface configured to fit to cavity assembly of a track so as to slide in relation thereto. A carriage unit can be positioned on the track to hold a body part in a specific position, whereby when an additional linear dimension is required for a surgical procedure, the track can be expanded to extend the body part to the predetermined position using the same positioner device.

5 Claims, 9 Drawing Sheets

(56) References Cited

U.S. PATENT DOCUMENTS

| | | | | |
|---|---|---|---|---|
| 7,740,016 | B1 * | 6/2010 | Pigg | A61B 6/0421 128/869 |
| 8,782,832 | B2 * | 7/2014 | Blyakher | A61B 6/0421 5/601 |
| 2005/0081865 | A1 * | 4/2005 | Hubert | A61G 13/12 128/845 |
| 2016/0279008 | A1 * | 9/2016 | Limoni | A61G 13/1245 |

* cited by examiner

EXPANDABLE BASE PLATE FOR KNEE POSITIONER

FIELD OF THE INVENTION

The present invention relates to positioner devices and, more specifically, to an expandable base plate configured to expand and to hold, move and maintain a body part in a specific position as needed in orthopedic surgery using the same positioner device.

BACKGROUND OF THE INVENTION

Surgical procedures increasingly require that the joint, limb or body part to be operated upon to be precisely and predictably positioned during such surgery. The overall time for a procedure should be a short as possible from the viewpoint of patient health and cost. In the cost aspect, the longer a procedure takes, the costlier it is. The cost aspect is affected by the cost of the surgeon, the support staff, the facility, and other cost factors.

In some procedures repositioning of a patient or the patient's limb is required because when the patient reaches the operating facility it is determined in positioning that a larger or longer limb additions to the operating table to position and maintain a hold of the body part for the procedure. For example, in orthopedic knee surgery a tall patient with a long leg exceeds the standard operating table. Additional extensions can be required, which adds to set-up time and overall procedure cost.

Not only must such selected position be maintainable, it also is important, and often necessary, that the limb be released and repositioned on demand during the course of the procedure to ensure optimum access, for example, repositioned for effective surgery in a variety of angular relationships. Some knee surgeries require repositioning to extend larger limbs to an alternative position and then to maintain and hold the knee in such position for that part of the procedure. Conventional equipment requires adding an extension or other equipment to the operating table to accommodate larger limbs so as to accomplish the repositioning step. These additional steps in the procedure create additional cost and effectively require additional time of the surgeon, patient and facility.

Moreover, if an extension or other equipment requires sterilization, or the re-sterilization, a sterilization step requires additional time effectively adding to the procedure cost in a similar manner. As sterilization facilities are separate from operating rooms flash sterilization can be the only practical solution. Time and cost is added to procedures as flash sterilization methods require placing in hot liquids to remove pathogens and, then afterwards, instruments may take longer to reach the required room-temperature after sterilization while cooling. These factors delay the surgical procedure and add to its cost.

Current equipment and processes are not addressing such problems of positioning of larger limbs. Furthermore, for conventional equipment that can extend, such equipment typically has a complex construction with numerous parts that are not easily or cost effectively sterilized. Moreover, for current equipment having a complex construction, these are not easily sterilized utilizing flash sterilization, which can increase the time and cost of the medical procedure. As a result, there is a problem in the conventional art that much time is required to position and maintain a larger and/or longer limb for a surgical procedure.

As a result, there is a need for an expandable plate for holding, moving and maintaining a body part a specific position such as may be needed in orthopedic surgery. A need also exists for an expandable plate for holding, moving and maintaining a knee positioner that has advantages of reducing the cost of the surgical procedure in terms of the time of the surgery. A need further exists in the art to overcome the sterilization disadvantages of a complex larger construction in the operating facility sterilization such as flash sterilization.

The expandable plate of the present invention is configured to extend the knee holder so as to accommodate larger limbs. A surgeon can easily adjust the expandable plate without adding time and cost of the procedure. The expandable plate of the present invention, and its simplified construction, provides an improved base plate for holding, moving and maintaining a body part in orthopedic surgical procedures with advantages of ease of adjusting, sterilization, and lowering the cost of the surgical procedure.

SUMMARY OF THE INVENTION

An object of the present invention is to provide an apparatus and method for determining, maintaining or holding a specific position of a limb such as may be needed in orthopedic surgery featuring an expandable base utilized for positioning larger limbs using the same positioner device.

Another object of the present invention is to provide an apparatus as aforesaid which is relatively simple to assemble and use. Such assembly and/or use may utilize skills which a surgeon already possesses or is familiar with and may utilize equipment already present in an operating room It is an object of the present invention to provide advantages of the apparatus, system and method of determining, maintaining or holding a specific position of a knee as may be needed in orthopedic surgery of a larger individual by utilizing an expandable base plate so as to utilize equipment already present in an operating room. The expandable base can extend the carriage of a holder for a knee positioner, for example, to determine, maintain or hold a specific position position of the knee of a larger limb. Thus, the present apparatus and method reduces operating costs and shortens the time to the surgeon, operating staff and/or patient in the surgical procedure.

BRIEF DESCRIPTION OF THE DRAWINGS

Non-limiting and non-exhaustive embodiments of the present invention are described with reference to the following drawings. In the drawings, like reference numerals refer to like parts throughout the various figures unless otherwise specified.

For a better understanding of the present invention, reference will be made to the following Description of the Embodiments, which is to be read in association with the accompanying drawings, which are incorporated in and constitute a part of this specification, show certain aspects of the subject matter disclosed herein and, together with the description, help explain some of the principles associated with the disclosed implementations, wherein.

DESCRIPTION OF THE EMBODIMENTS

Figure 1:
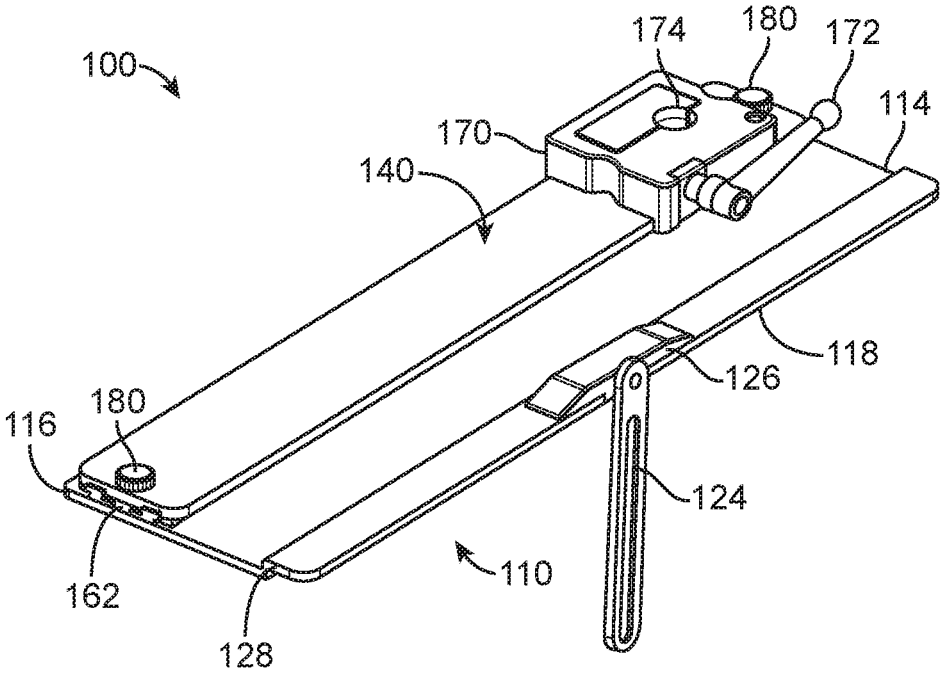
FIG. 1 is a perspective view of the preferred apparatus, system, and method in accordance with an embodiment of the present invention, as it appears when the expandable plate assembly uses a carriage in one position.
Figure 2:
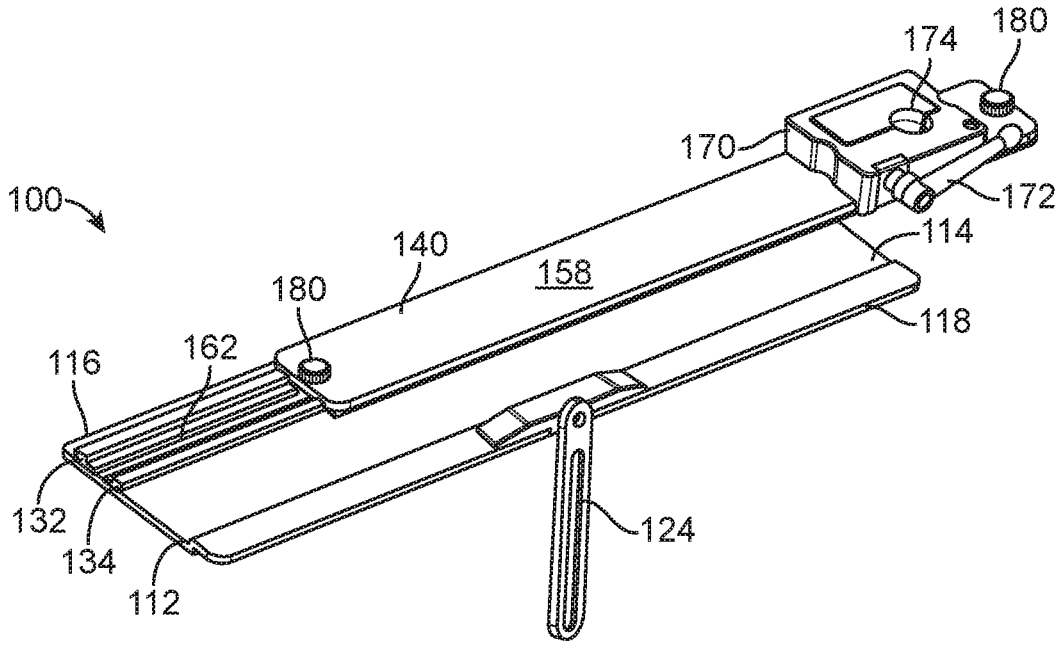
FIG. 2 is a perspective view of the preferred apparatus, system, and method in accordance with an embodiment of the present invention, as it appears when the expandable plate assembly uses a carriage in an expanded position.
Figure 3:
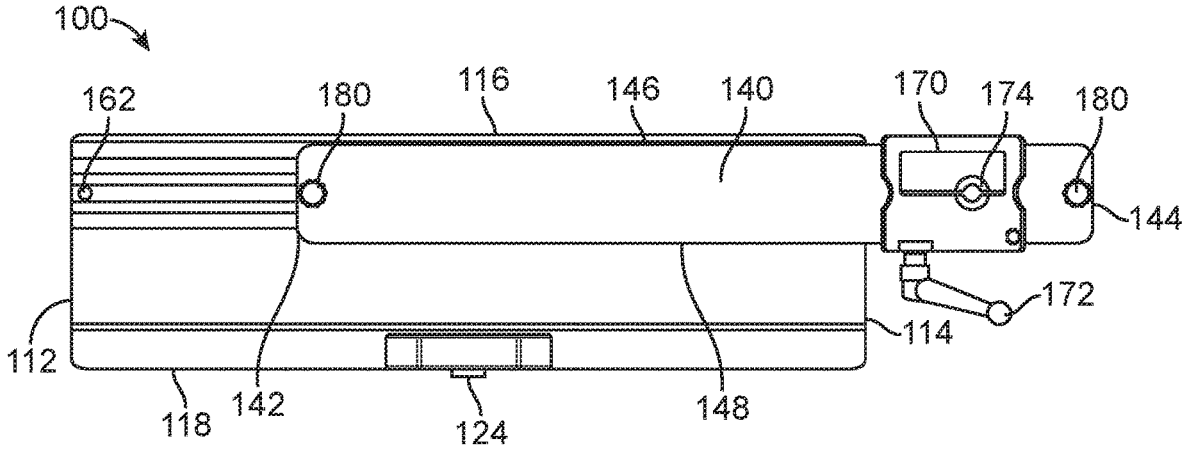
FIG. 3 is a top view of the preferred apparatus, as it appears when the expandable plate and carriage assembly in an extended position.

Non-limiting embodiments of the present invention will be described below with reference to the accompanying drawings, wherein like reference numerals represent like elements throughout. While the invention has been described in detail with respect to the preferred embodiments thereof, it will be appreciated that upon reading and understanding of the foregoing, certain variations to the preferred embodiments will become apparent, which variations are nonetheless within the spirit and scope of the invention.

The terms "a" or "an", as used herein, are defined as one or as more than one. The term "plurality", as used herein, is defined as two or as more than two. The term "another", as used herein, is defined as at least a second or more. The terms "including" and/or "having", as used herein, are defined as comprising (i.e., open language). The term "coupled", as used herein, is defined as connected, although not necessarily directly, and not necessarily mechanically.

Reference throughout this document to "some embodiments", "one embodiment", "certain embodiments", and "an embodiment" or similar terms means that a particular feature, structure, or characteristic described in connection with the embodiment is included in at least one embodiment of the present invention. Thus, the appearances of such phrases or in various places throughout this specification are not necessarily all referring to the same embodiment. Furthermore, the particular features, structures, or characteristics may be combined in any suitable manner in one or more embodiments without limitation.

The term "or" as used herein is to be interpreted as an inclusive or meaning any one or any combination. Therefore, "A, B or C" means any of the following: "A; B; C; A and B; A and C; B and C; A, B and C". An exception to this definition will occur only when a combination of elements, functions, steps or acts are in some way inherently mutually exclusive.

The drawings featured in the figures are provided for the purposes of illustrating some embodiments of the present invention, and are not to be considered as limitation thereto. Term "means" preceding a present participle of an operation indicates a desired function for which there is one or more embodiments, i.e., one or more methods, devices, or apparatuses for achieving the desired function and that one skilled in the art could select from these or their equivalent in view of the disclosure herein and use of the term "means" is not intended to be limiting.

As used herein the term "bed" or "plate" refers to a generally planar structure with a small thickness compared to the planar dimensions. Useful materials for manufacturing the plate include surgical stainless steel or any grade of corrosion resistant steel that are used in biomedical applications such as, for example, the most common "surgical steels" are austenitic 316 stainless and martensitic 440 and 420 stainless steels.

As used herein the term "expandable" or "extendable" refers to a system for increasing in a linear dimension, or having the capacity for expanding a predetermined amount such as, for example, between 20" inches and 36" inches, an expandable base plate configured to expand and adjust on-demand so as to hold, move and maintain a body part in a specific position as needed in orthopedic surgery using the same positioner device, for example, a carriage assembly that holds and maintains the body part in a predetermined position.

As used herein the term "track" refers to a metal structure forming a path that a carriage unit or other positioning device rides on, or moves along, as well as used to hold and maintain a body part in a specific position as needed in orthopedic surgery using the same positioner device.

As used herein the term "carriage" or "carriage unit" refers to a structure, rig or assembly configured to carry a holder of a body part in orthopedic surgery. The carriage unit is configured to hold, move and maintain a body part in a specific position as needed in orthopedic surgery. The teachings of a transformable carriage assembly of U.S. Provisional Patent Application No. 61/986,013 filed on Apr. 29, 2014 are incorporated by reference.

As used herein the term "body" "body part" "extremity" or "limb" refers to a body part or extremity consisting of foot, ankle, knee, leg, hand, wrist, arm and shoulder of a patient.

As used herein the term "holder" or "extremity holder" refers to a device or a means for supporting the body part, or joint thereof, of a patient in the preparation for surgery or medical activity and/or during surgery to hold a body part for access to the body part. A holder can be used to position the body part such as an arm or leg for patient preparation.

As used herein the term "patient" refers to any recipient of health care services. The patient is most often ill or injured and in need of treatment by a surgeon, physician, physician assistant, advanced practice registered nurse, veterinarian, or other health care provider.

As used herein the term "medical activity" refers to the provision of medical care consisting of hospital activities, medical and dental practice activities, and "other human health activities" by a surgeon, physician, physician assistant, advanced practice registered nurse, veterinarian, or other health care provider.

As used herein the terms "surgery", "operation" "surgical procedure" or refers an act of performing surgery such as by a surgeon, or simply to investigate and/or treat a pathological condition such as disease or injury, or to help improve bodily function or appearance using operative manual and instrumental techniques on a patient to in the medical specialty context. The adjective surgical means pertaining to surgery; e.g. surgical instruments or surgical nurse. The patient or subject on which the surgery is performed can be a person or an animal.

As illustrated in FIGS. 1-9, an expandable base plate assembly 100 is configured for securing to an operating table (not shown) as well as for supporting and securing a carriage unit 170 thereto. The expandable base plate assembly 100, and components thereof, is formed from a solid material such as metal, aluminum, stainless steel, surgical steel, and/or metal alloys. The expandable base plate assembly 100 is separable into a minimum of parts that advantageously can be sterilized, used repeatedly, and then attached to the operating table lowering the surgical procedure cost thereby. The expandable base plate assembly 100 has a generally rectangular planar shape of a dimension that advantageously can be flash sterilized in the operating room.

Figure 4:
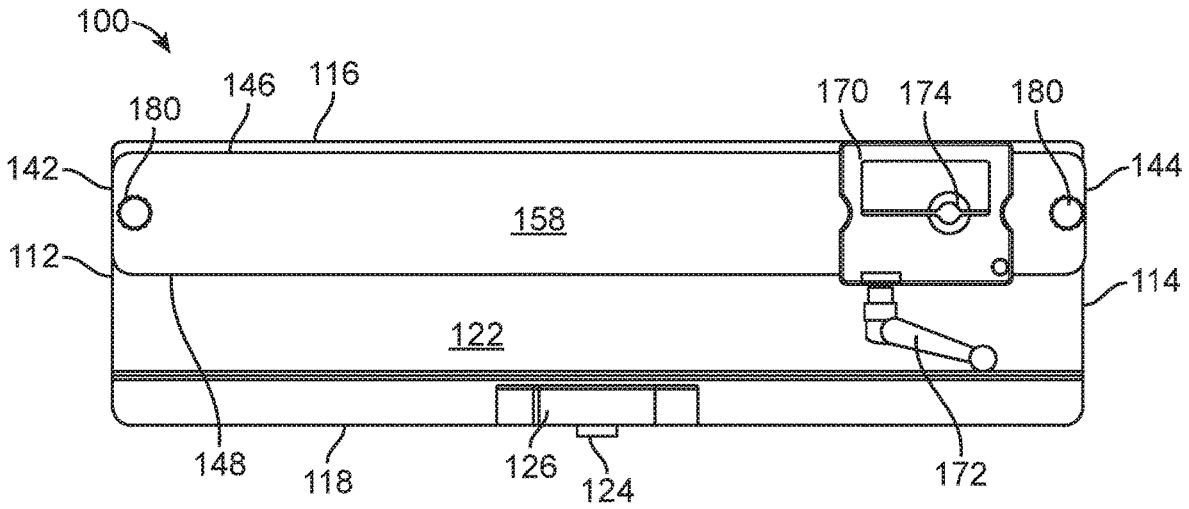
FIG. 4 is a top view of the preferred apparatus, as it appears when the expandable plate assembly in one position.
Figure 5:
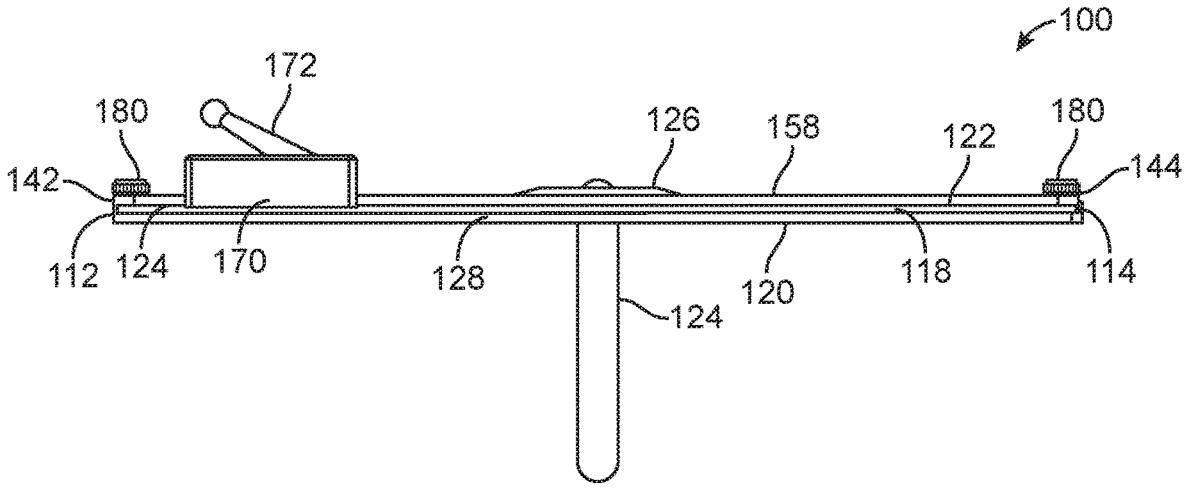
FIG. 5 is a side view of the preferred apparatus, as it appears when the expandable plate assembly in one position or closed.
Figure 6:
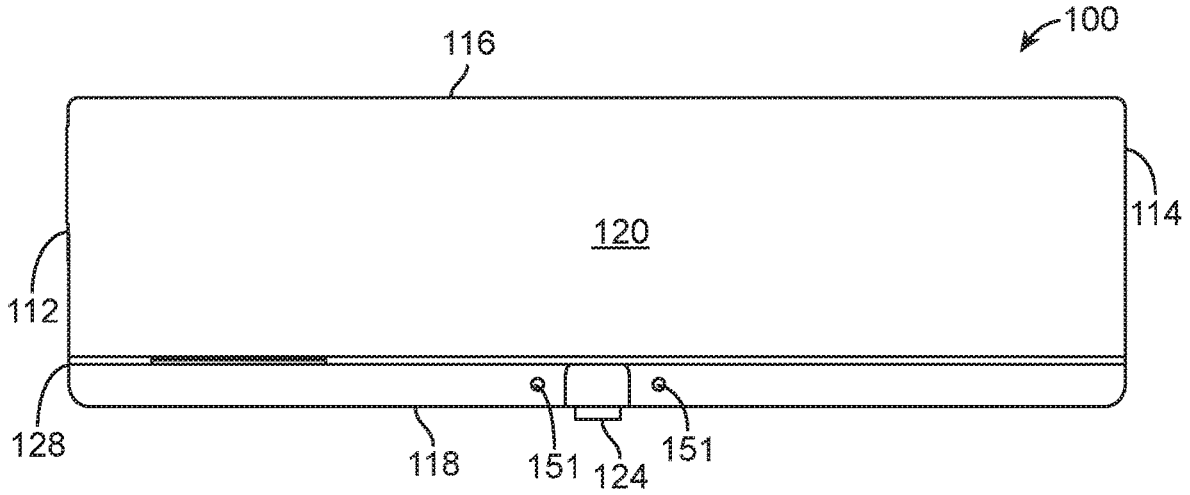
FIG. 6 is a bottom view of the preferred apparatus, as it appears when the expandable plate assembly in one position.

Referring to FIGS. 1-3 and 7-9, the expandable base plate assembly 100 is configured with a bed 110 formed generally from a flat rectangular plate with opposite parallel vertical end edges 112, 114. Because the bed 110 is intended for use in an operating room environment, it is formed from materials that are durable, sturdy, and that can be repeatedly sterilized such as, for example, most commonly formed from surgical stainless steel that is known to reduce bacterial and early bio-film attachment, other suitable metals and metal alloys. The bed 110 has flat vertical lateral edges 116, 118 perpendicular to vertical end edges 112, 114. The bed 110 has a flat bottom surface 120, as shown in FIGS. 4, 5 and 6. The bed 110 has a top surface 122 configured with a guide means 130. One or more of the flat vertical lateral edges 116, 118 of the bed 110 is adapted to connect a bar or transverse arm 124 affixed at a mid-portion of the bed 110, for example, bar 124 is secured to lateral edge 118, which can be used to secure the assembly 110 to the operating table. The bar 124 is disposed at an angle perpendicular to the flat bottom surface 120 of the bed 110.

Figure 7:
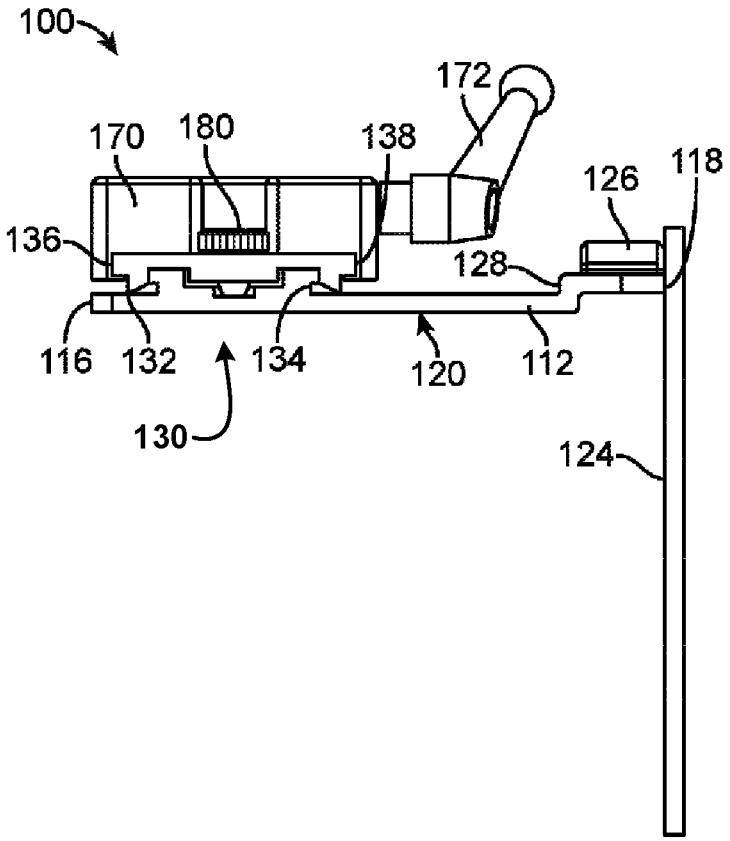
FIG. 7 is a front view of the preferred apparatus, as it appears when the expandable plate assembly in one position.
Figure 8:
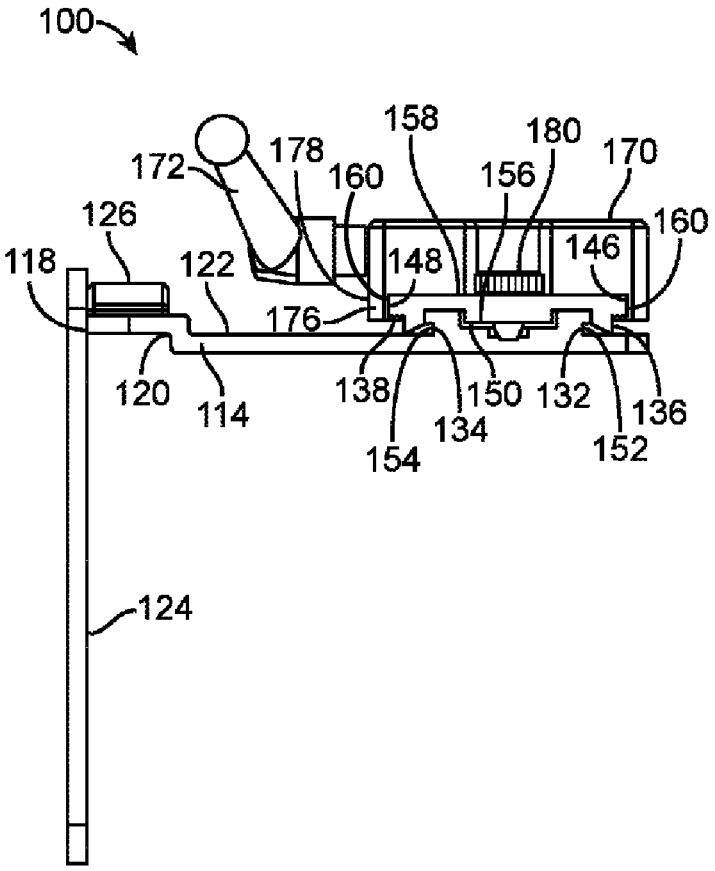
FIG. 8 is a back view of the preferred apparatus, as it appears when the expandable plate assembly in one position.
Figure 9:
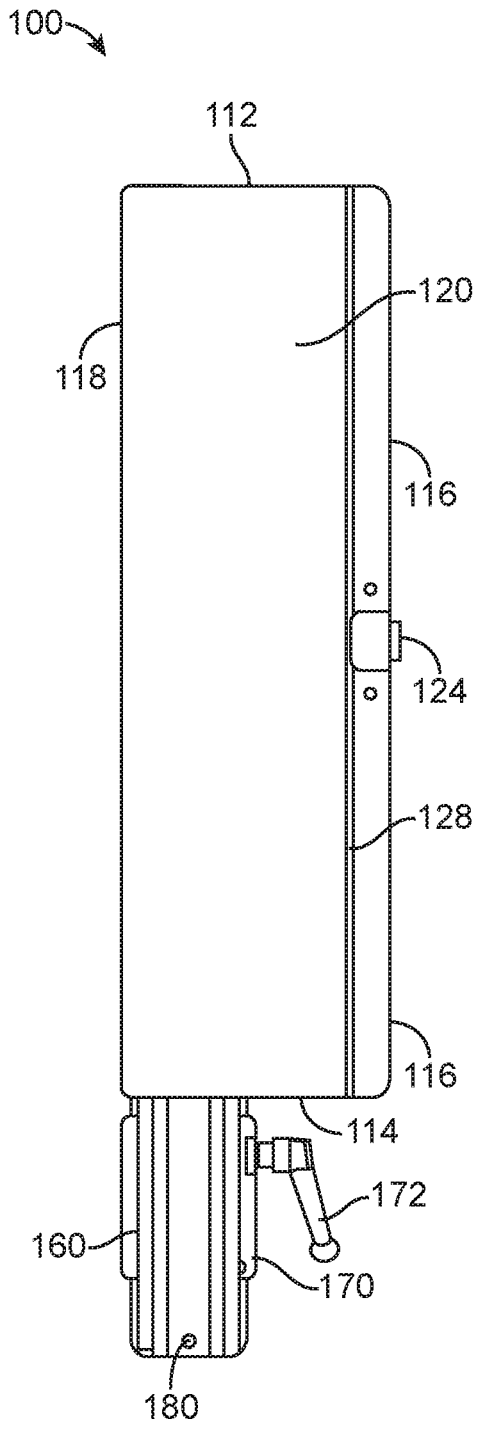
FIG. 9 is a bottom view of the preferred apparatus, as it appears when the expandable plate assembly in an expanded position.

Referring to FIGS. 7, 8 and 9, in the illustrated embodiment of the present invention, an improved guide assembly 130 comprises shoulders 132, 134 rising from the bed 110 connecting to opposite bar-like projections 136, 138. An extendable track 140 assembly is configured with parallel vertical end edges 142, 144 and vertical lateral edges 146, 148 perpendicular to end edges 142, 144, and a lower surface 156 and a flat upper surface 158, as shown in FIGS. 4, 5 and 6. The track 140 is formed from a solid material such as metal, aluminum, stainless steel, surgical steel, and/or metal alloys, and can be manufactured using automated computer numeric control (CNC) techniques. The track 140 has cavity assembly 150 formed in the lower surface 156. The cavity assembly 150 is configured as generally U-shaped with projections 152, 154 formed in the bottom surface 156 of the track 140; and each of the cavity 150 and projections 15 152, 154 also can be formed using (CNC) techniques.

The upper surface 158 of the track 140 is a generally flat planar surface configured to support a carriage unit 170 thereon. The carriage unit is described in provisional patent application No. 61/986,013 filed on Apr. 29, 2014. The vertical lateral edges 146, 148 of the track 140 are configured to fit a carriage guide groove 160 extending from end-to-end in the bottom of the carriage unit 170 so as to be positioned at a desired location of the track 140. The carriage guide grooves 160 are on each side of the track 140 structure and configured to guide the carriage unit 170 along the upper surface 158 of the track 140 and securely tighten the carriage unit 170 thereto.

The top surface 122 of the bed 110 has a unitary construction configured with the guide assembly 130 manufactured by, for example, using CNC machining techniques forming shoulder surfaces 132, 134 rising from the bed 110 connecting to opposite bar-like projections 136, 138 to form a generally raised flattened T-section for securing the cavity assembly 150 on the lower surface 156 of the track 140. The aforesaid flattened T-section forms a means for guiding or a guide assembly 130 eminently suitable for use in a surgical operation and for mounting a movable part of the cavity assembly 150 of the track 140.

The shoulder surfaces 132, 134 and opposite bar-like projections 136 138 are adapted to enter the cavity assembly 150 with some clearance advantageously allowing for sliding movement of the track 140 thereon so as to elongate the expandable base plate assembly 100. According to an embodiment of the present invention, the guide assembly 130 of the bed 110 is configured to be self-aligning during mounting the cavity assembly 150 of the track 140 thereon. The bed 110 and the track 140 units can be made of any required length within given limits so long as there can be free endless movement. According to an embodiment of the present invention, a suitable dimension of 20" inches that advantageously can be flash sterilized in the operating room. This dimension also allows for the expansion base plate assembly 100 to expand between 20" inches and 36" inches.

In a similar manner, track 140 is configured to receive and guide a carriage unit 170 thereon. The expandable base plate assembly 100 is adapted advantageously to expand by moving track 140 allowing the carriage unit 170 to be positioned to hold and maintain larger body parts in a predetermined position for a surgical procedure (not shown). The carriage unit 170 can include a handle 172 for one-hand operation by the user to loosen, tighten, position, and reposition. The carriage unit 170 is configured to hold an extremity holder adapted with a post connected to the holder at a proximate end and connectable by a ball at a distal end of the post, which ball fits to a socket 174, in the carriage unit 170. This carrier guide groove 160 is spaced laterally from downwardly extending shoulders 178 of the side portions of the carriage unit 170. The groove 160 extends from end-to-end of the side portion 178. Accordingly, in this way, the carriage unit 170 assembly can hold, move and maintain a body part in a specific predetermined position as needed in orthopedic surgery using the same device.

The arm 124 is a permanently mounted pivot arm that can be attached by a lug 126 secured to the top surface 122 adjacent, for example, vertical lateral edge 118. The lug 126 is configured to be attached by fasteners, for example, bolts 151 securing lug 126 to the top surface 122 thereto in a permanent mount to the bed 110, as is shown secured in the bottom surface 120 in FIG. 6. The lug 126 and bolts 151 can be manufactured from surgical steel. The bed 110 also can have a lip 128 formed to accommodate common rails of the operating table. The lip 128 can be formed in the bed 110 surfaces by bending, for example, the edge 118 is placed in step-forming bending machine.

The carriage unit 170 generally includes a track locking assembly 176 is utilized to secure the track 140 to the bed 110 thereby holding, maintaining and restricting further movement. The track locking assembly 176 comprises a flat shallow rectangular track fastener groove 162 is formed in a top surface 122 of the bed 110. The track locking assembly can use, for example, a track clamp tab to secure and hold the position of the carriage unit 170 to the track 140 by a compression friction fit in the operation of tightening the arm 172 thereby creating a clamping action.

One or more fasteners 180 are located at each end of the track 140 of assembly 100. Fasteners 180 are configured to be threaded to be received in the track 140 at vertical end edges 142, 144. An opposite end of each fastener 180 is configured to be received in a track fastener groove 162. Each fastener 180 is adapted to lock the track 140 in position when tightened, e.g. urging a blunt nose of the fastener 180 against the track fastener groove 162 into frictional engagement. Similarly, the fastener 180 is adapted to unlock from the track 140 and allow movement by loosening the threads. In operation of an extended, expanded position, the tightening of one fastener 180, as shown in FIGS. 7 and 9 causes the track to not be able to slide, thereby holding, maintaining and restricting further movement of it in relative to the bed 110.

In operation, the expandable base plate 100 can be attached to the operating table by suitable fasteners, for example, locking onto the arm 124 attached to bed 110 using a standard clamp of the operating table. In order to position a larger limb or body part, such as a knee, the foot is placed in the extremity holder. Fasteners 180 are loosened, track 140 is adjusted to position the knee, and then the fasteners are tightened. The carriage unit 170 can be further positioned along the track 140 and tightened thereto by the one-arm motion to turn handle 172. Various adjustments can be made using the same expandable plate assembly 100 by adjusting fasteners 180, moving track 140, and moving the carriage unit along the track 140 thereby holding and maintaining a limb in a predetermined position, and restricting further movement of the knee during a surgical procedure. The expandable base plate 100 has an improved construction where the static load capacity is the maximum radial load that can be applied while there is no relative motion between the carriage and track. In this manner, the expandable base plate assembly 100 has numerous advantages including a minimum number of parts that reduces the cost of sterilization, maintenance, and manufacture; improved use with larger patients; and being able to be used with existing equipment. The interaction between the guide assembly 130 and the track 140, the track 140 and the carriage guide groove(s) 160 and the fastener(s) 180 and the track fastener groove 162 of the bed 110 have an inherent self-aligning-in-all-directions design that allows for ultra-smooth travel when mounted on wider tolerance prepared surfaces. The self-aligning design allow for more deviation in the flatness of the mounting surface which can dramatically reduce wear and provide improved cleaning and sterilization after the operation, which has increased challenges when tissues and debris are lodged in complex parts and hard to reach locations. For example, the entire track slides off, e.g. the track 140 from the bed 110 and the carriage unit 160 from the track 140. The expandable base plate assembly 100 design offers advantages of increased bearing load capacities, enhanced obtainable travel life, and improved performance when compared to competitive assemblies.

While certain configurations of structures have been illustrated for the purposes of presenting the basic structures of the present invention, one of ordinary skill in the art will appreciate that other variations are possible which would still fall within the scope of the appended claims. Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An apparatus for securing to a surgical table to position a limb of a patient for a surgical procedure, said apparatus comprising: an expandable base plate assembly comprising a bed of a generally rectangular plate with a top surface, a bottom surface, a plurality of vertical end edges and a plurality of vertical lateral edges; a guide assembly formed on a surface of said bed, said guide assembly having one or more shoulders and one or more projections extending from said top surface of said bed; a track comprising a generally flat planar surface including a plurality of vertical lateral edges configured to operably connect to a plurality of carriage guide grooves, said track configured with a cavity extending between a plurality of vertical end edges on a lower surface of said track, said cavity configured with one or more track projections extending into said cavity from said vertical lateral edges of said track, said one or more track projections configured to operably connect said cavity to said guide assembly for sliding movement of said track relative to said bed in a linear direction; and a carriage assembly configured to operably connect by said plurality of carriage guide grooves to said track of said bed, said carriage assembly configured to be positioned on said track by sliding movement of said carriage assembly relative to said track in said linear direction; and a limb holder configured to operably connect to said carriage assembly, said limb holder configured to receive and secure the limb of the patient in a predetermined position for the surgical procedure.

2. An apparatus for securing to an operating table for holding a limb of a patient in a specific position on the operating table, said apparatus comprising: a bed comprising a substantially planar plate with a bottom surface, a top surface, a plurality of vertical end edges and a plurality of vertical lateral edges, said top surface configured with a lug secured to one of said plurality of vertical lateral edges, said top surface further comprising a guide assembly configured with one or more shoulders and projections extending from said top surface of said bed; a track comprising a generally flat planar surface configured with a lower surface, an upper surface, a plurality of vertical end edges, and a plurality of vertical lateral edges, said lower surface of said track configured with a cavity extending between said plurality of vertical end edges configured with one or more projections extending from said plurality of vertical lateral edges located on said lower surface of said track adapted to operably connect said cavity to said guide assembly so as to allow slidable movement of said track in a linear direction, said vertical lateral edges of said upper surface configured to operably connect to a plurality of carriage guide grooves a carriage assembly configured to operably connect by said plurality of carriage guide grooves to said track, said carriage assembly configured to move along said track for positioning said carriage assembly relative to said track in said linear direction; and a limb holder operably connected to said carriage assembly, said limb holder configured to receive and secure the limb of the patient in a predetermined position for a surgical procedure.

3. The apparatus of claim 2 further comprising an arm operably connected to said lug, said lug configured to operably connect said arm to said top surface of said bed.

4. A base plate for securing to an operating table for holding a limb of a patient in a specific position on the operating table, said base plate comprising: a bed comprising a substantially planar plate with a bottom surface, a top surface, a plurality of vertical end edges and a plurality of vertical lateral edges and a guide assembly configured with one or more shoulders and projections extending from said one or more shoulders of said bed; a track comprising a generally flat planar surface configured with a lower surface, an upper surface, a plurality of vertical end edges, and a plurality of vertical lateral edges, said lower surface of said track configured with a cavity extending between said plurality of vertical end edges configured with one or more projections extending from said plurality of vertical lateral edges located on said lower surface of said track adapted to operably connect said cavity to said guide assembly so as to allow slidable movement of said track in a linear direction, said vertical lateral edges of said upper surface configured to operably connect to a plurality of carriage guide grooves; and a carriage assembly configured to operably connect by said plurality of carriage guide grooves to said track, said carriage assembly configured to move along said track for positioning said carriage assembly relative to said track in the said linear direction.

5. The base plate of claim 4 further comprising a limb holder operably connected to said carriage assembly, said limb holder configured to receive and secure the limb of the patient in a predetermined position for a surgical procedure.

* * * * *